US008631628B1

(12) United States Patent
Beicker et al.

(10) Patent No.: US 8,631,628 B1
(45) Date of Patent: Jan. 21, 2014

(54) TILT-UP CONCRETE SPANDREL ASSEMBLIES AND METHODS

(75) Inventors: Davy L. Beicker, San Antonio, TX (US); Stephen H. Schuetze, New Braunfels, TX (US)

(73) Assignee: Clearview Composite Wall System, LLC, San Antonio, TX (US)

( * ) Notice: Subject to any disclaimer, the term of this patent is extended or adjusted under 35 U.S.C. 154(b) by 0 days.

(21) Appl. No.: 13/406,513

(22) Filed: Feb. 27, 2012

Related U.S. Application Data

(60) Provisional application No. 61/437,519, filed on Feb. 25, 2011.

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04B 1/35*** | (2006.01) |
| *E04G 23/02* | (2006.01) |

(52) U.S. Cl.
CPC ..... *E04B 1/35* (2013.01); *E04G 23/0203* (2013.01)
USPC ..... 52/745.2; 52/742.14

(58) Field of Classification Search
USPC ..... 52/742.1, 742.13, 742.14, 742.15, 52/745.19, 745.2, 745.09, 745.1, 633, 634, 52/636, 638, 474, 481.1, 764, 781.5
See application file for complete search history.

(56) References Cited

U.S. PATENT DOCUMENTS

| | | | | |
|---|---|---|---|---|
| 1,179,678 | A | | 4/1916 | Swift |
| 2,703,003 | A | | 3/1955 | Ruppel |
| 3,129,481 | A | | 4/1964 | Sullivan |
| 3,394,523 | A | | 7/1968 | Sackett, Sr. |
| 3,401,497 | A | | 9/1968 | Gregory, Jr. et al. |
| 3,555,763 | A | | 1/1971 | Bloxom |
| 3,940,902 | A | | 3/1976 | Reale |
| 3,990,193 | A | | 11/1976 | Ray et al. |
| 4,107,886 | A | | 8/1978 | Ray et al. |
| 4,185,423 | A | | 1/1980 | Gutierrez |
| 4,856,244 | A | * | 8/1989 | Clapp ..... 52/309.7 |
| 4,909,007 | A | | 3/1990 | Bodnar |
| 4,930,278 | A | | 6/1990 | Staresina et al. |
| 5,177,914 | A | | 1/1993 | Hilmer |
| 5,414,972 | A | | 5/1995 | Ruiz et al. |
| 5,526,629 | A | | 6/1996 | Cavaness |

(Continued)

OTHER PUBLICATIONS

"Whit is Tilt-Up Construction? How Are Tilt-Up Concrete Buildings Constructed?", Articles on Tilt-Up Construction, Aug. 18, 2010, Tiltup.com.

(Continued)

*Primary Examiner* — William Gilbert
*Assistant Examiner* — Kyle Walraed-Sullivan
(74) *Attorney, Agent, or Firm* — Rosenthal Pauerstein Sandoloski Agatehr LLP; William H. Quirk; Daniel A. Rogers

(57) ABSTRACT

A system and method of tilt-up or tiltwall concrete building construction using concrete spandrels cast on-site together with permanent steel columns that are integrally attached to unite the spandrels into a lightweight and versatile tilt-up assembly that is strong and durable and that can be safely and efficiently made and maneuvered into final position for cost-effective building construction, the resulting assembly also allowing for continuous horizontal spans of ribbon-like window glass with minimal obstruction, thereby maximizing visibility and natural lighting and enabling easy accommodations for architectural requirements.

20 Claims, 8 Drawing Sheets

Wall Panel Assembly 100

NOT TO SCALE

(56) References Cited

U.S. PATENT DOCUMENTS

| | | | | |
|---|---|---|---|---|
| 5,913,793 | A * | 6/1999 | Hills | 52/741.13 |
| 5,987,827 | A | 11/1999 | Lord | |
| 6,067,575 | A | 5/2000 | McManis et al. | |
| 6,438,918 | B2 * | 8/2002 | Moore et al. | 52/426 |
| 6,631,599 | B1 | 10/2003 | Takagi | |
| 6,668,507 | B2 | 12/2003 | Blanchet | |
| 6,708,459 | B2 | 3/2004 | Bodnar | |
| 6,817,151 | B2 | 11/2004 | Foderberg et al. | |
| 6,837,013 | B2 | 1/2005 | Foderberg et al. | |
| 6,857,241 | B1 | 2/2005 | Pellicer | |
| 7,028,439 | B2 | 4/2006 | Foderberg et al. | |
| 7,231,746 | B2 | 6/2007 | Bodnar | |
| 7,278,244 | B1 | 10/2007 | Rubio | |
| 7,426,808 | B2 | 9/2008 | Sanger | |
| 7,666,258 | B2 | 2/2010 | Guevara et al. | |
| 7,780,894 | B2 | 8/2010 | Jones | |
| 2002/0069602 | A1 * | 6/2002 | Blanchet | 52/600 |
| 2006/0191232 | A1 | 8/2006 | Salazar et al. | |
| 2006/0284049 | A1 * | 12/2006 | England | 249/114.1 |
| 2007/0234664 | A1 | 10/2007 | Tucker | |
| 2008/0313991 | A1 * | 12/2008 | Chouinard | 52/506.01 |
| 2009/0049778 | A1 | 2/2009 | Kralic | |
| 2010/0011688 | A1 * | 1/2010 | Moran | 52/250 |
| 2010/0050552 | A1 * | 3/2010 | David et al. | 52/431 |

OTHER PUBLICATIONS

"Tilt Up", Wikipedia, Sep. 21, 2008.

Tilt Up Concrete Association newsletter, "The Architecture of Concrete", 2nd E, 2011, pp. 43, 44.

2007 Brochure entitled "EZ-Tilt-Up" from Concrete Forms Services, West Jordan, UT, found on their website: www.concreteformsservices.com.

* cited by examiner

Wall Panel Assembly 100

NOT TO SCALE

Cross Section View –
Concrete Spandrel 10

NOTE: BEARING LEDGERS, LIFTING EMBEDS
AND JOISTS NOT SHOWN FOR CLARITY

NOT TO SCALE

End Wall Panel Assembly 110

NOT TO SCALE

Cross Section View –
End Wall Panel Assembly 110

NOTE: BEARING LEDGER AND STEEL JOISTS NOT SHOWN FOR CLARITY

NOT TO SCALE

Concept Building Arrangement

NOT TO SCALE

Wall Panel Assembly 100

NOT TO SCALE

End Wall Panel Assembly 110

NOT TO SCALE

Partially Cut-Away View

Stylistic Arrangement

TILT-UP CONCRETE SPANDREL ASSEMBLIES AND METHODS

NONPUBLICATION REQUESTED

This application is a utility application under 37 CFR 1.53 (b) and is submitted with an accompanying non-publication request in accordance with 35 U.S.C. §122(b). Accordingly, the subject matter of this application is to be maintained in secrecy until and unless Applicant allows a patent to issue based on this application.

CLAIM OF PRIORITY TO PRIOR APPLICATION

This application claims the benefit of the filing date of U.S. Provisional Application Ser. No. 61/437,519, filed on Feb. 25, 2011, entitled "Tilt-Up Concrete Spandrel Assemblies and Methods", the entire disclosure of which is hereby incorporated by reference into the present disclosure.

FIELD OF THE INVENTION

The present invention pertains generally to the field of tilt-up or tiltwtiltwall concrete building construction. More particularly, the present invention relates to construction methods and systems using reinforced concrete panels that are cast on-site and then tilted up to form exterior walls that are structurally sound yet aesthetically attractive.

BACKGROUND

After more than a century of refinement, tilt-up concrete construction is a highly cost-effective form of building construction that has long been dominant in many parts of North America. The tilt-up construction technique (sometimes referred to as "tiltwall") uses reinforced concrete panels that are cast in horizontal forms at the construction site. Once poured and cured horizontally, the concrete panels are then tilted up with a crane and positioned to form the vertical exterior walls of the building—hence, the "tilt-up" name.

Considering the process in more detail, tilt-up construction typically begins with standard job site preparation and the pouring of the building's foundation slab. Typically before or while the slab's concrete is poured and cured, workers position steel embeds around the slab, wherever vertical steel columns of the building's structural framework will later be connected to the slab. As an alternative to positioning embeds before the pour, such embeds are sometimes installed after the concrete is poured, which is referred to as "post-installed." The position of the embeds is secured temporarily, and the slab is poured so the embeds are embedded in the concrete—hence, the "embed" designation. Other slab accommodations are also made for plumbing, electrical and the like, as is well known in the art, although some secondary accommodation steps can be postponed until after the tilt-up panels are finished.

After the foundation slab with its embeds for the columns is complete, the process of forming the tilt-up walls generally commences, with the foundation slab itself being used as an on-site horizontal casting surface for some or all of the wall panels. Ideally, the tilt-up wall panels are cast where the finished panels can later be tilted up directly into their final positions without significant repositioning, but some degree of lifting and moving is often required. The outline of each panel is chalked or marked on the slab, and each panel's outer form is built around that outline, usually fabricated on-site with wood planks such as two-by-eights positioned and secured in place around the panels outlined outer perimeter. Door and window accommodations are created by inner forms built in the midst of the outer forms, as will be discussed further below.

Skipping ahead for a moment, once the forms are finished and a bond-breaking release agent is applied on the inside surfaces of the form and casting slab, an engineered rebar mat is built and blocked in the casting space as appropriate for panel strength. Various types of embeds, inserts and the like are also positioned where needed in the casting space, most critically to enable later crane attachment and connection of the panel to the other structural components once the panel is finished. Concrete is then poured over the rebar mat and allowed to cure, thereby creating the continuous slab of reinforced concrete in the shape of the space formed between the inner and outer forms. After the tilt-up concrete has cured, the forms are removed and the concrete panels are tilted from horizontal to vertical. Cranes are used to tilt the walls up, and the walls are then temporarily braced into position around the space that will ultimately become the building's interior, where the building's steel framework is then built. As the interior steel framework is erected, that framework is permanently secured in various stages, primarily to the foundation embeds and, ultimately, to the tilt-up walls and roof structure.

Referring again to the door and window accommodations, most multi-story tilt-up panels are designed with rectangular openings to allow for windows, doors and the like. Such openings are generally created by inner forms built in the shapes of the desired openings (again, typically made of wood) in the midst of the outer form. Window openings are usually made by rectangular inner forms that are positioned several feet from any part of the outer forms. Door openings are usually formed by rectangular inner forms built directly against the "bottom" edge of the outer form—i.e., against the edge that will define the lower/bottom edge of the tilt-up panel once it is tilted into place. Accommodation is also needed in the design of the rebar mat, so that the rebar mat only lies in the casting space between the inner and outer forms. Such accommodation in the rebar mat allows the inner form to be positioned and secured within the shape of the panel's overall outer form before the pour commences. Although a panel's door and window openings introduce stress concentrations that might cause the finished panel to fail, great care is taken to make sure that the thickness, width and overall strength of the resulting concrete spans are more than adequate to ensure structural soundness and building code compliance. Concrete is then poured over the rebar mat between the inner and outer forms to create a continuous reinforced concrete panel in the shape of the space between the inner and outer forms. If the resulting openings risk compromising the strength or stability of the concrete panel during the tilt-up process, steel beams called strongbacks can be temporarily secured over the weaker sections to provide added reinforcement until the panel is secured to the building's steel framework.

Despite the long history and widespread use, standard methods of tilt-up construction still have significant disadvantages. For one, because tilt-up panels undergo substantial lateral and tensile loads while being tilted from horizontal to vertical and often encounter moderate impact forces while being positioned under crane suspension once complete, the size and geometry of each tilt-up panel is necessarily limited.

Significant architectural planning is also needed with tilt-up construction—both for interior design as well as exterior appearance. The vertical concrete spans on each side of each window or door opening must be wide, thick and reinforced enough to ensure adequate strength for the final structure. As a result, overall window space for any given wall panel tends to be limited, which presents multiple architectural challenges. The relatively small window space not only tends to create a cheaper look on the outside, but it also means that more architectural accommodation is needed to ensure adequate lighting and visibility for interior spaces. Moreover, once the walls are up, the spacing of the vertical concrete spans is set in stone, so to speak, which creates challenges in matching interior floor plans with the exterior window openings.

As for exterior appearance, some builders have tried to overcome the cheap look of relatively-small windows in fixed geometries by installing strip glass windows that extend over the vertical concrete spans as well as the window openings. Such solutions help minimize the gingerbread-house look of typical tilt-up wall panels, but they add another layer of complexity, and the construction budget then has to pay for both the reinforced concrete and the window glass over the same outer wall portion.

To make it even more challenging, the material and labor cost for each individual tilt-up panel is typically based primarily on the outer dimensions of the panel. Add in the extra costs for inner form materials, and it actually makes the reinforced concrete part of a windowed panel more expensive than a solid panel of the same overall outer dimensions, not to mention hidden costs such as the increased risk of structural failure. As a result, even though a panel with window openings requires less concrete and rebar than one of the same overall size without window openings, the windowed panel is significantly more costly even before considering the glass and its mounting. So, much of the cost-effectiveness of tilt-up construction often gets lost in trying to make architectural accommodations.

Another problem with the current method of tilt-up panel construction is the weight of the wall panels. Wall panels constructed using prior tiltwall techniques are very heavy for their size. Their tremendous weight makes them expensive to handle and, in turn, requires a more robust and expensive foundation.

While it is typical to construct panels that weigh more than twenty tons, the strongest of cranes and substantial temporary bracing are often required during construction. The tremendous weight also requires extra measures to protect the safety of the building crew and equipment, to guard against horrific disaster in the event primary supports fail. Very stringent precautions and special equipment is needed when lifting and bracing these heavy wall panels.

Many other problems, obstacles, limitations and challenges will be evident to those skilled in the art, particularly in light of the literature and experiences that are known in the industry.

BRIEF SUMMARY OF THE INVENTION

Despite the systemic constraints that are inherent in the highly-evolved tilt-up construction industry, the present invention is directed to basic objects of providing an improved finished construction that improves and overcomes many of the challenges of the prior art without compromising adequate strength, safety or durability.

Various aspects of the present invention combine to generally enable an attractive, durable, inexpensive, and lightweight method for construction of multi-story tilt-up wall panels and final building structures. The present invention keeps or improves on the strength, safety and durability of tilt-up construction while also enabling building designs that have greater window ratios and cleaner architectural lines and that also reduce the cost of concrete labor and materials as well as the overall weight of the panels.

Presently preferred embodiments of the present invention, which will be described subsequently in greater detail, generally comprise multiple, non-contiguous sub-castings that are structurally united during fabrication—before the combined assembly is tilted up. The result forms a compound tilt-up assembly with dramatically improved visibility through the open spans between its multiple sub-castings. With sub-castings designed to ultimately function much like independent spandrels, the structural union between the spandrel sub-castings is preferably formed in part by a plurality of steel columns that are permanently integrated with the sub-castings to span between them and unite them as a unitary panel assembly while they are still in their horizontal casting arrangement.

While alternative embodiments approach the steel column integration using various techniques, a joining face of the columns—i.e., a face that generally lies flat against the upper surface of each subcasting while it is being cured—preferably has an array of protruding anchors that become embedded in the subcastings while they are being poured and cured. Preferably, the anchors are in the form of studs directly stud-welded to the joining face of the columns. Multiple steel columns span across each of the spandrel subcastings, with their respective anchors being spaced at incremental spaces in the rebar mat. Once all is in position, the anchors and the joining face of the columns are cast directly into the spandrels during the forming process.

The system and method for the construction of tilt-up panels according to the present invention substantially departs from the conventional concepts and designs of the prior art, and in so doing provides a method that has many advantages and novel features which are not anticipated, rendered obvious, or even suggested or implied by any of the prior art, either alone or in any obvious combination thereof. Many other objects, features and advantages of the present invention will become evident to the reader and it is intended that these objects, features and advantages are within the scope of the present invention.

While the benefits of the invention are more numerous than mentioned here, the use of such compound tilt-up assemblies allows for the construction of larger tilt-up wall panels while reducing material and labor costs of the construction process. The resulting lighter weight panels allow still other cost efficiencies while maintaining the durability, safety and strength of conventional tilt-up wall panels.

In this respect, before explaining at least one embodiment of the invention in detail, it is to be understood that the invention is not limited in its application to the details of the particular methods of construction, nor to the particular arrangements of components set forth in the following descriptions or illustrated in the drawings. The invention is capable of many other embodiments and of being practiced and carried out in numerous other ways. Also, it is to be understood that the phraseology and terminology employed herein are for the purpose of the description and should not be regarded as limiting. While it should be recognized that this invention may be embodied in the form illustrated in the accompanying drawings, the description and drawings are illustrative only, and numerous changes may be made in the specifics illustrated or described.

DETAILED DESCRIPTIONS OF PREFERRED EMBODIMENTS

Figure 2:
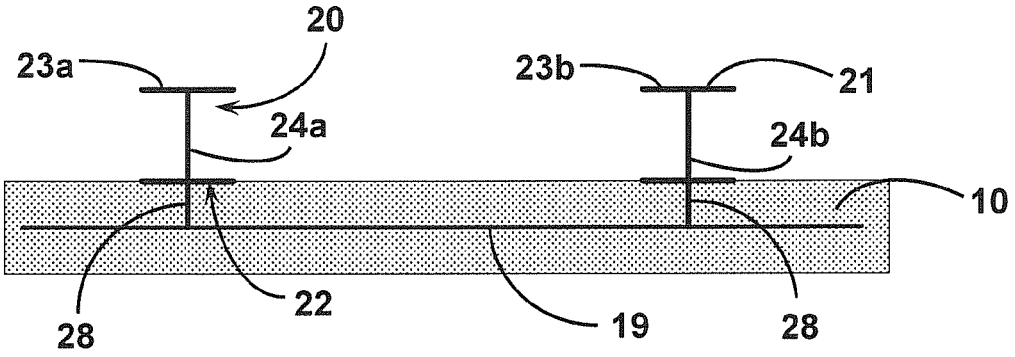
FIG. 2 is a partial cross-sectional side view of the wall panel assembly 100, showing concrete spandrels 10-13, steel members 20-21, embedded shear studs 28 and rebar mat 19.
Figure 8:
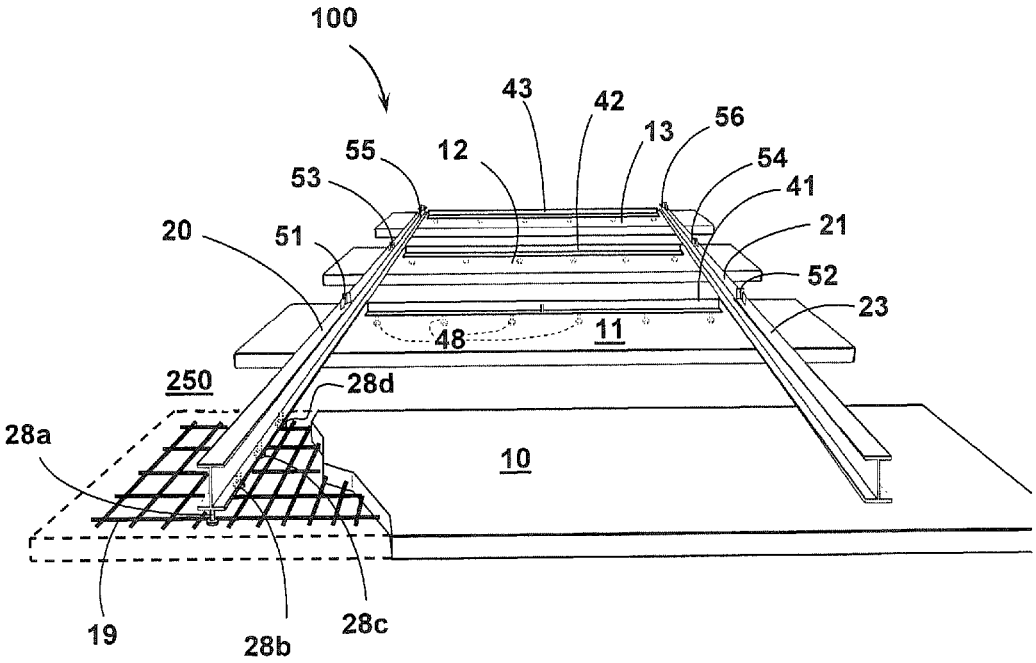
FIG. 8 is a partial cross-sectional perspective view of concrete spandrel 10, steel members 20-21, embedded shear studs 28 and rebar mat 19.

Reference is now made to the drawings describing in detail the contemplated best mode and preferred embodiments of the present invention. Concrete spandrel 10 is preferably cast on-site as a reinforced concrete spandrel 10 (shown in FIGS. 2, 4, and 8), that is integrally united with and by steel members 20-21 during the casting process. Steel members 20-21 are preferably conventional structural steel members and may have any viable structural steel shape, many of which are standard in the industry. To enable the integral union of the concrete spandrels 10 and steel members 20-21, members 20-21 are preferably stud-welded with a suitable arrangement of shear studs 28 before casting, in positions that allow the studs 28 to protrude from steel members 20-21 into the casting space for each concrete spandrel 10 such that they become embedded within the concrete of each concrete spandrel 10 during the casting process.

The arrangement of embedded shear studs 28 are welded to steel members 20-21 at incremental spaces as required by the art and any applicable building codes or standards, such as a single row (or, alternatively, a pair of rows) of shear studs spaced every twelve or twenty-four inches, centered along the bottom flange 22 of each steel member 20-21. It should be recognized that stud spacing may also vary depending on the profile, gauge and length of each stud 28 as compared to the dimensions and strength of the concrete spandrels 10 in which they are to be embedded, depending also on the various structural and dynamic loads for which the building structure is designed. The steel members 20-21 are placed into the form over a rebar mat 19. The figures show the placement of the steel members 20-21, rebar mat 19, and embedded shear stud 28 within the various concrete spandrels 10-15. The rebar mat 19 extends to the perimeter of the form and is supported by spacers (not depicted) to raise the mesh off the bottom surface of the form. This allows a reasonable amount of concrete to cover the rebar mat 19. Said rebar mat 19 can be of any numerous types as is known in the art that may not have been specifically disclosed but would fall within the scope of the invention, including double or single mat.

As an alternative to the shear stud approach as described above, alternative embodiments use fasteners for permanently joining the steel members 20-21 to the concrete spandrels 10 using any of a variety of mechanisms known in the art for attaching steel members 20-21 to embedded shear studs 28 or other forms of embeds, or to or through the concrete itself and/or the rebar mat 19 therein. Preferably, such alternative embodiments still achieve an integral joinder of spandrels and steel members in a manner that is permanent, while also preferably meeting both code and design specifications. For each tiltwall assembly 100, generally a minimum of two permanent steel members 20-21 are used, each one of the two preferably positioned relatively near each lateral end of the concrete spandrels 10-13, although preferably spaced at least three-feet inward from those lateral ends. If so desired, additional permanent and/or temporary steel members can also be added to each tiltwall assembly 100 in alternative embodiments. As is well known in the art, various types of embeds, inserts and the like are also positioned where needed in the casting space for the appropriate concrete spandrel 10. These embeds are used to connect the wall panel assembly 100 and end wall panel assemblies 110, 111 to the foundation slab 250, as well as to the roof, to the other wall panel assemblies, and to floor joists 60 and the like for constructing the various internal floors of the completed building. Also some of the various embeds are of the types that can be used to enable later crane attachment and connection of the tiltwall panel assemblies 100, 110, 111 to the other structural components once the panel is finished.

The casting surface is typically treated with a bond-breaker material to prevent the newly poured concrete from adhering to the floor. A form is constructed and concrete is poured as is known in the art. The concrete is cured and treated as is known in the art thereby creating the reinforced concrete panel in the shape of the form. The panel is lifted from the form (typically after removal of some or all of the form members) by conventional use of an overhead hoist or crane. The lifting hooks of the overhead hoist or crane are preferably connected to lifting inserts **30*a*-30*h* that have been cast or post-installed in select concrete spandrels 10. Alternatively, the lifting cables of the overhead hoist or crane may be connected to holes or other adaptations 29*a*-29*d* in one or more flanges 23*a*, 24*a* of steel member 20 and one or more flanges 23*b*, 24*b* of steel member—21. Other alternative embodiments of certain aspects of the invention use any other lifting technique known in the art. The lifting, placing, and bracing of the tiltwall panel assemblies 100** are accomplished as is customary in the tilt-up panel industry.

Figure 1:
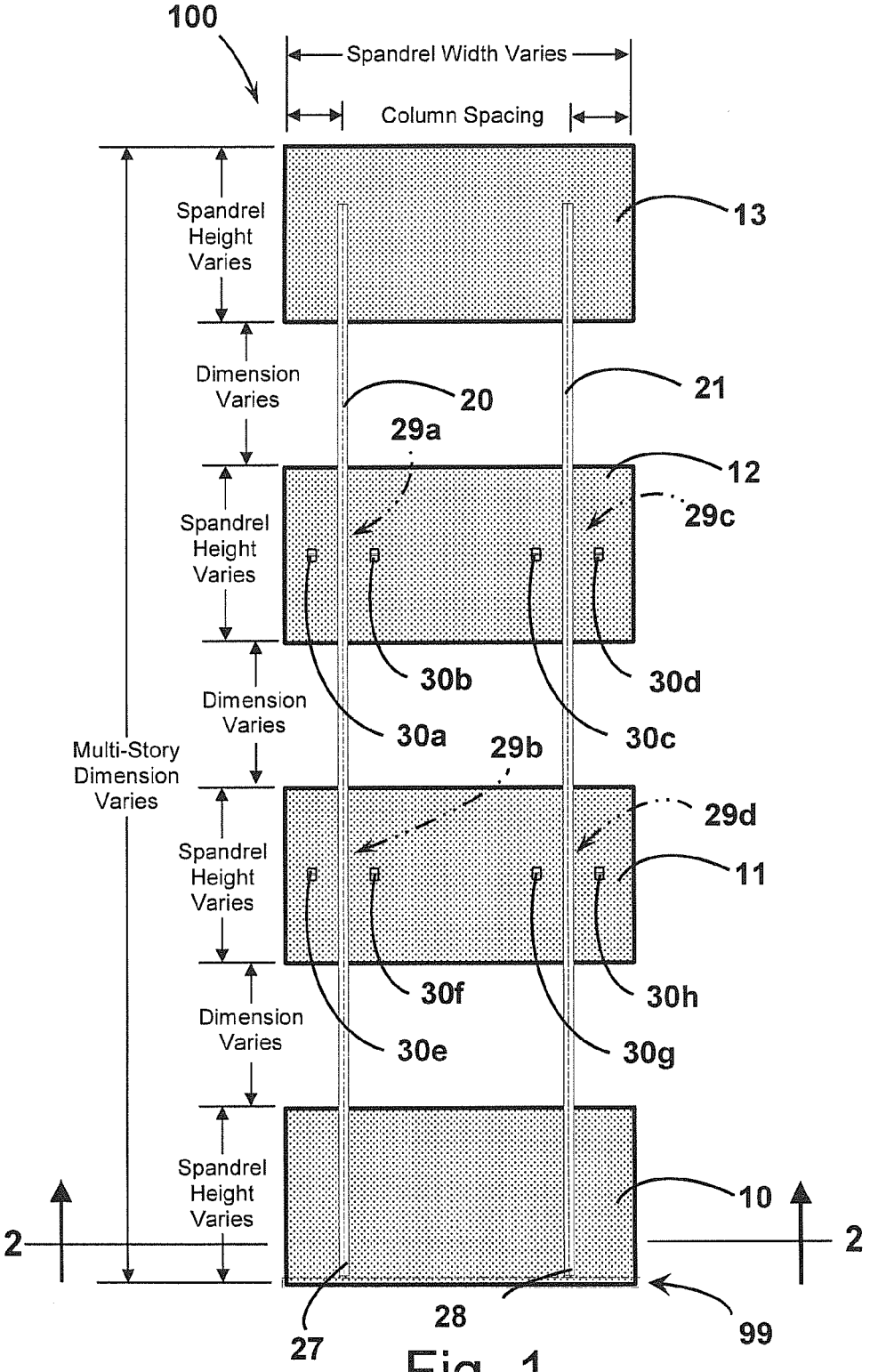
FIG. 1 is a partially schematic front plan view of the placement and positioning of the structural elements of the wall panel assembly 100, which includes a number of reinforced concrete spandrels 10-13 united with permanent steel members 20-21.

Reference is now made to FIG. 1 for a description of the overall structure of the wall panel assembly 100 of the preferred embodiment. The tiltwall panel assembly 100 is generally comprised of a varying number of concrete spandrels 10 integrally united together by permanent attachment to a number of steel members 20-21.

Figure 3:
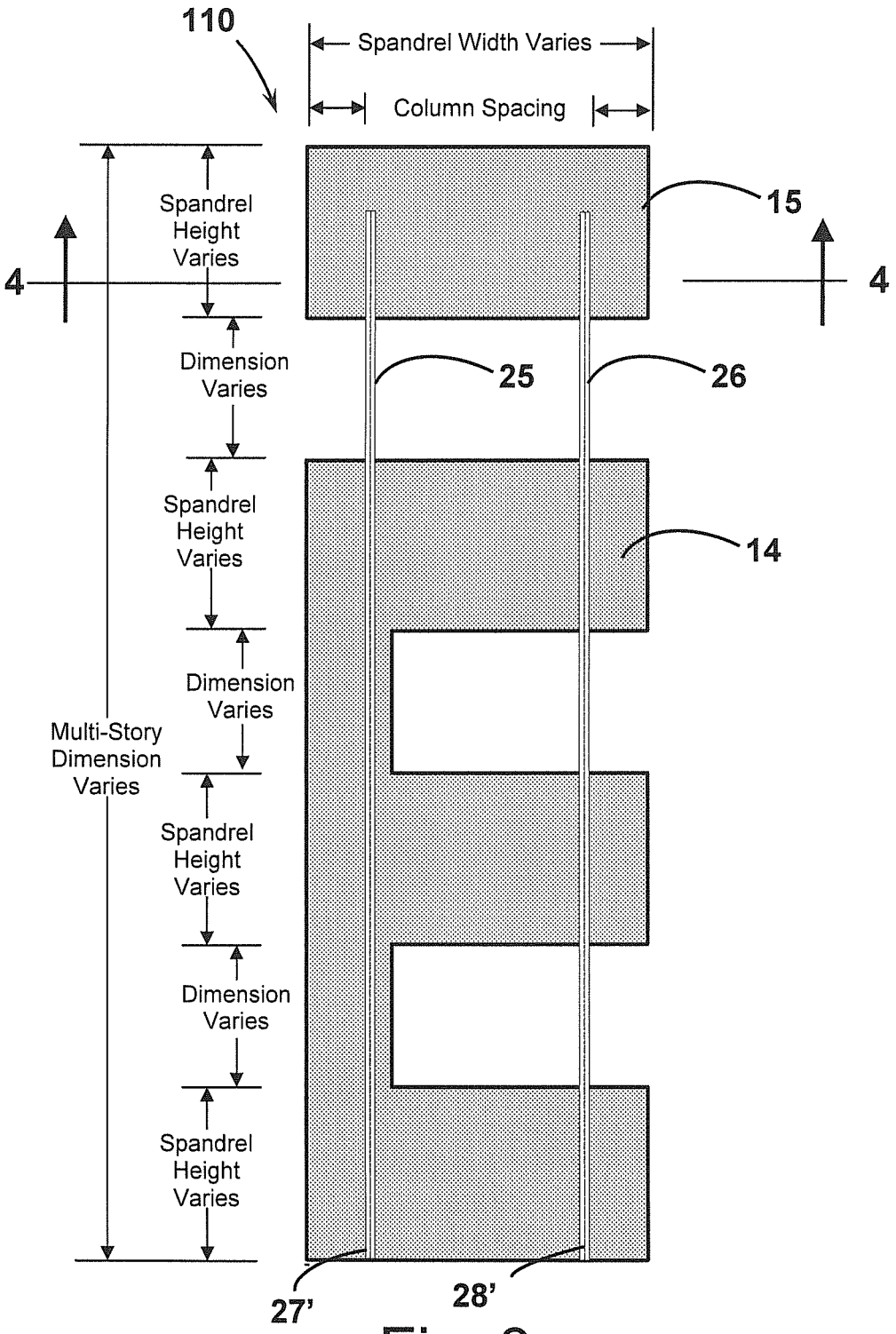
FIG. 3 is a partially schematic front plan view of the placement and positioning of the structural elements of an end wall panel assembly 110, which includes a standard reinforced concrete spandrel 15 together with a multi-story, multi-spandrel casting 14 united with and by steel members 25-26.
Figure 5:
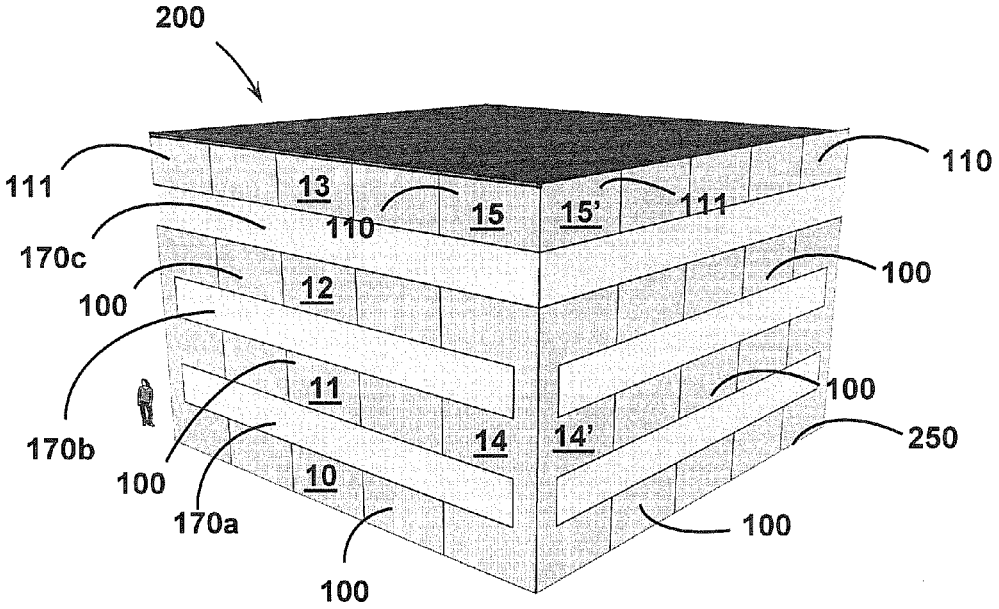
FIG. 5 is a concept building arrangement 200 showing the general placement of multiple wall panel assemblies 100, including multiple end wall panel assemblies 110 and 111, in combination to form the exterior walls of building 200.
Figure 6:
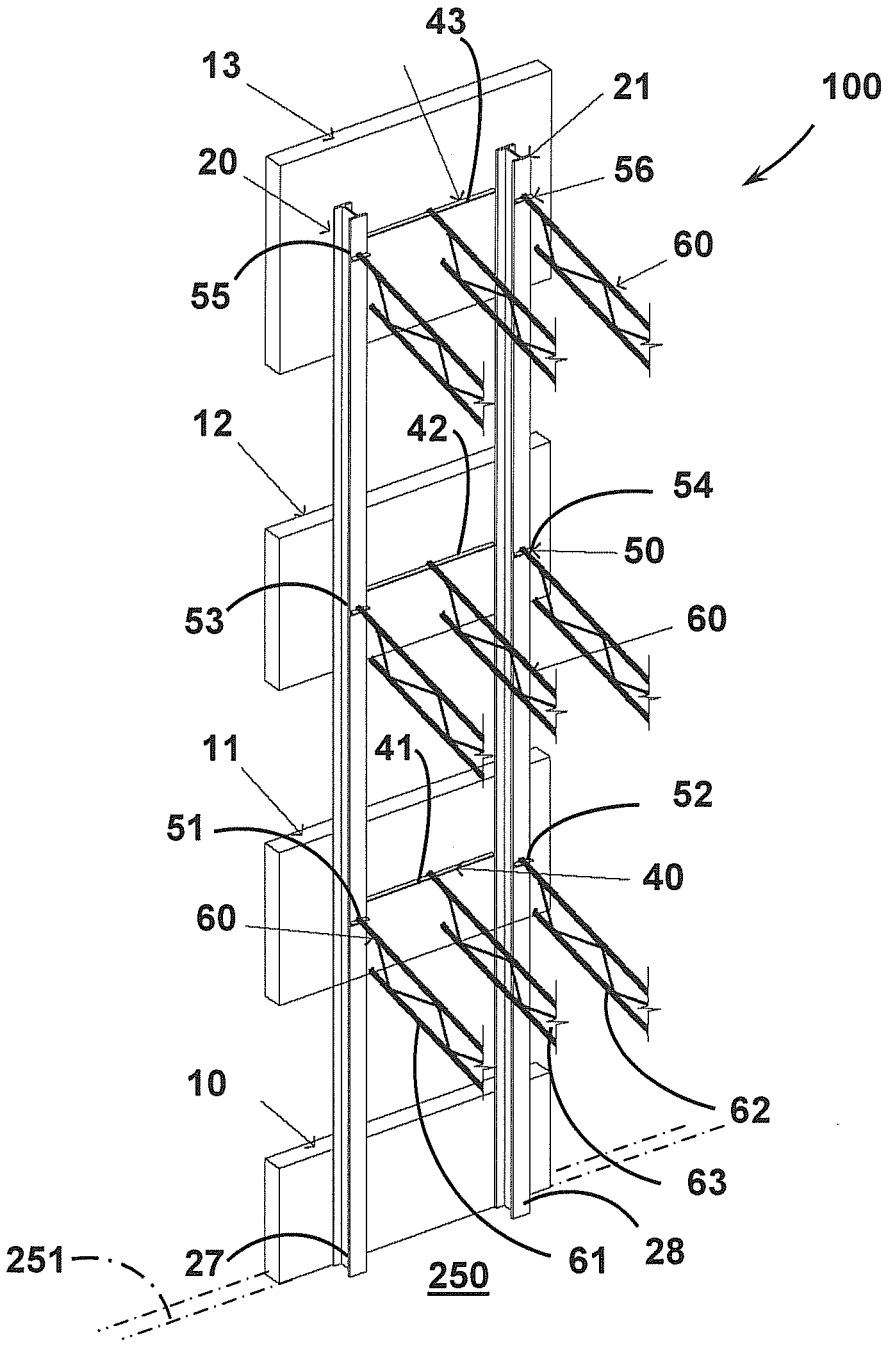
FIG. 6 is a perspective view of the wall panel assembly 100 formed by the union of concrete spandrels 10-13 and steel members 20-21, which include embedded steel bearing ledgers 41-43 and welded steel bearing ledgers 51-56 for connecting the tiltwall assembly 100 to the various structural joists 60-63 that will ultimately support the floors and roof of a final structural arrangement such as arrangements 200, 210 shown in FIGS. 5 and 9, respectively.
Figure 7:
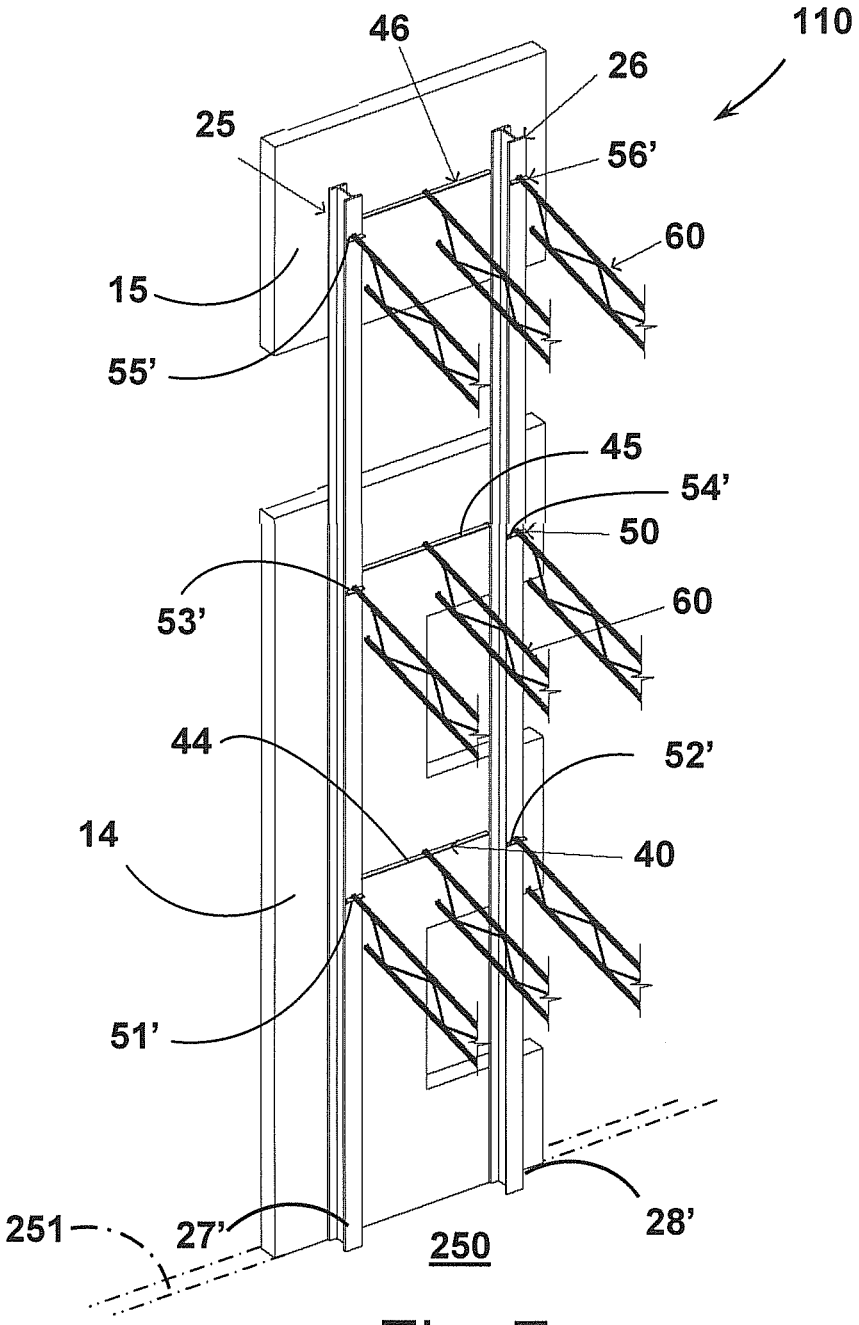
FIG. 7 is a perspective view of the end wall panel assembly 110, created by a combination of reinforced concrete castings 14-15 and steel members 25-26, which include embedded steel bearing ledgers 44-46 and welded steel bearing ledgers 51'-56' for connecting the tiltwall assembly 110 to the various structural joists 60.
Figure 9:
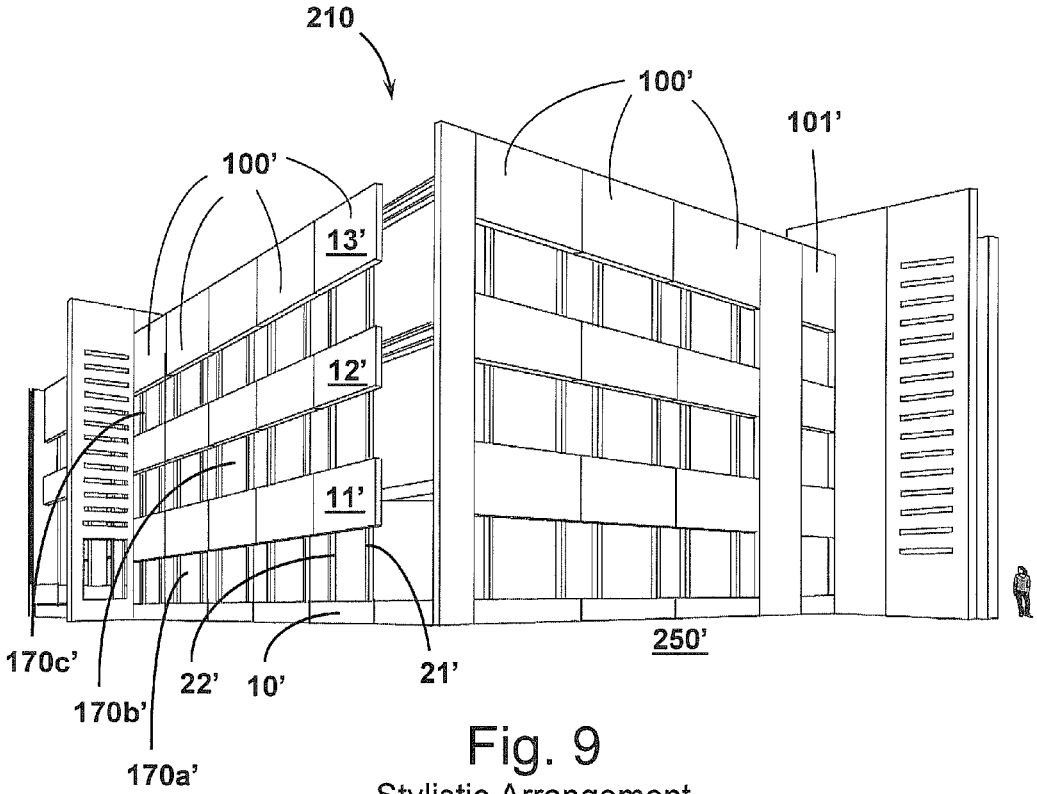
FIG. 9 is a ground-level perspective view of stylistic building arrangement 210 showing an alternative placement of multiple varied wall panel assemblies constructed according to the teachings of the present invention, which combine to form the exterior walls of building 210.

While reference to "concrete spandrel 10" (as contrasted from "spandrel 10") is used as a generic reference to various illustrated spandrels in this description (to the extent the context permits), alternative embodiments of concrete spandrel 10 are represented by spandrel variations 10, 11, 12, and 13 in FIGS. 1, 5, 6 and 8; spandrel variations 10', 11', 12' and 13' in FIG. 9; and spandrels 15, 15' and, for some aspects of certain variations of the invention, multi-spandrel castings 14, 14' in FIGS. 3, 5 and 7. On a similar note, reference to "tiltwall assembly 100" (as contrasted from "panel assembly 100") will be used as a generic reference to the various illustrated panel assemblies in this description, to the extent the context permits. Alternative embodiments of tiltwall assembly 100 are represented by panel assembly 100 in FIGS. 1, 5, 6 and 8; panel assemblies 100' and 101' in FIG. 9; and panel assemblies 110 and 111 in FIGS. 3, 5 and 7 (assembly 111 only being shown directly in FIG. 5).

The exact dimensions, shapes and relative spacing of the tiltwall assemblies 100 and their respective concrete spandrels 10 can vary according to the building specifications and aesthetics. Some of the variable dimensions are indicated in FIGS. 1 and 3 by the descriptive phrases "Spandrel Height Varies," "Dimension Varies," "Spandrel Width Varies," "Multi-Story Dimension Varies," and "Column Spacing Varies" in FIGS. 1 and 3. Numerous other types of variations will be evident to those of ordinary skill in the art, and many are evident from this description. For instance, differing dimensions and embeds are illustrated for different ones of concrete spandrel variants 10, 11, 12, and 13, as required for varying functional objectives. The various dimensions of concrete spandrels 10-13 as well as their placement as part of the tiltwall assembly 100 are determined by the building and safety requirements, taking into account construction and safety standards as well as the building code and architectural requirements as known by those in the art.

Additionally, variants of concrete spandrel 10 may contain different combinations of the various embeds and inserts known in the art. Some of the known types of embeds provide connections for attaching cables to tilt the tiltwall assemblies 100 up and for otherwise hoisting and maneuvering the assemblies 100 using an overhead crane or the like. Those same embeds and others can be used as connection points for temporary struts to brace the tiltwall assemblies 100 prior to final attachment to the other building structures. Other embeds are used to connect the wall panel assembly 100 to the foundation 250, the roof, and to the other tiltwall assemblies 100, as well as to the horizontal steel framework for constructing each of the various internal floors of the completed building.

For example, in the present embodiment, some or all of the concrete spandrels 10 of tiltwall assembly 100 will contain embeds to connect the tiltwall assembly 100 to the foundation 250, the roof, and temporary bracing, as well as other embeds for internal flooring as well as connections to other tiltwall assemblies 100 and mountings for later installation of windows 170 (shown in FIG. 5) or the like. Spandrel 10 will contain embeds and inserts suitable for connecting the wall panel assembly 100 to the foundation 250; whereas spandrel 13 will contain embeds and inserts suitable for connecting the wall panel assembly 100 to the roof and/or the joists that support the roof of the final building structure.

The construction, type, combinations, placement, and other features of these embeds are well known to those in the tilt-up panel industry. Additionally, the various methods of bracing the tiltwall assemblies 100 are well known in the art. The present invention has the added benefit of reducing the total height to weight ratio of the tiltwall assemblies, thus, increasing the safety margins of the currently known methods of bracing and attaching tiltwall panels. The lower height to weight ratio of the total tiltwall assembly 100 also has the added benefits of lower costs, since the builder is only paying for the actual volume of concrete poured instead of the total volume of the complete tiltwall assembly 100. Those skilled in the art will have understanding of the various embeds, inserts, configurations, types, combinations, and subcombinations of concrete spandrels 10 variants and steel members 20-21 that may not have been specifically disclosed but would fall within the scope of the invention.

In the present embodiment, spandrels 10-13 are attached to two steel members 20-21 according to the method set forth above for welding the steel members 20-21 to embedded shear stud 28. The fasteners can be of any of a variety of mechanisms known in the art for attaching steel members 20-21 to embedded shear studs 28. For each tiltwall assembly 100, generally a minimum of two steel members 20-21 are used, preferably one near each lateral end of the arrangement of spandrels 10-13. However, if so desired, a greater number of steel members 20 can be fastened to the tiltwall assemblies 100.

Reference is now made to FIG. 3 for a description of the overall structure of the end wall panel assembly 110 of the preferred embodiment. The end wall panel assembly 110 is generally comprised of a spandrel 15 and spandrel 14 attached to a number of steel members 25-26. As with the wall panel assembly 100 of FIG. 1, the exact number and dimensions of concrete spandrel 10 variants and steel members 25-26 can vary as needed by the building and safety requirements for the specific building being constructed. In the present embodiment, the end wall panel assembly 110 differs from the simpler form of wall panel assembly 100 as shown in FIG. 1, in that spandrel variant 14 (also referred to as a "multi-spandrel casting") is shaped similar to an "E". The end wall panel assembly 110 is generally constructed such that it aligns with the shape of the adjacent wall panel assembly 100.

As with the concrete spandrel 10 variants contained in the tiltwall assembly 100, the concrete spandrel 10 variants in the end wall panel assembly 110 may contain different combinations of the various embeds and inserts known in the art used to connect the end wall panel assembly 110 to the foundation 250, the roof, to the other tiltwall assemblies 100, and to construct the various internal floors of the completed building. In the present embodiment, spandrel 15 will contain embeds to connect the end wall panel assembly 110 to the roof as well as other embeds for internal flooring and connections to other tiltwall assemblies 100. In this embodiment, the spandrel 14 will contain embeds and inserts needed to connect the end wall panel assembly 110 to the foundation 250 as well as embeds necessary to brace the end wall panel assembly 110.

The construction, type, combinations, placement, and other features of these embeds are well known to those in the tilt-up panel industry. Additionally, the various methods of bracing the end wall panel assemblies are well known in the art. The present invention has the added benefit of reducing the total height and weight ratio of the end wall panel assemblies, thus, increasing the safety margins of the currently known methods of bracing and attaching tiltwall panels. The lower height to weight ratio of the total end wall panel assembly 110 also has the added benefits of lower costs, since the builder is only paying for the actual volume of concrete poured instead of the total volume of the complete end wall panel assembly 110. Those skilled in the art will have understanding of the various embeds, inserts, configurations, types, combinations, and subcombinations of concrete spandrel 10 variants and steel members 25-26 that may not have been specifically disclosed but would fall within the scope of the invention.

In the present embodiment spandrels 15 and 14 are attached to two steel members 25-26 according to the same methods referenced above for welding the embedded shear studs 28 to steel members 20-21. Alternatively, fasteners for joining the steel members 25-26 (or 20-21) to the concrete spandrels 10 can be of any of a variety of mechanisms known in the art for attaching steel members 25-26 to embedded shear studs 28 or other forms of embeds, preferably in a manner that forms a permanent joinder that meets both code and design specifications. For each end wall panel assembly 110, generally a minimum of two steel members 25-26 are used, one relatively near each lateral end of the concrete spandrel 15 and 14. However, if so desired, a greater number of steel members 25-26 can be fastened to the tiltwall assemblies 100.

The dimensions of concrete spandrels 15 and 14 as well as their placement as part of the end wall panel assembly 110 are determined by the building and safety requirements taking into account construction and safety standards as well as the building code as known by those in the art. Those skilled in the art will have understanding of the various configurations, types, combinations, and subcombinations of concrete spandrels 10 and steel members 25-26 that may not have been specifically disclosed but would fall within the scope of the invention.

Figure 4:
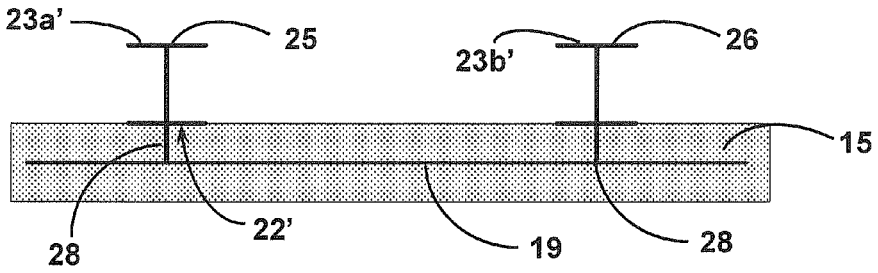
FIG. 4 is a partial cross-sectional side view of the end wall panel assembly 110, showing concrete panel 15, steel members 25-26, embedded shear studs 28 and rebar mat 19.

As shown in FIG. 4, the concrete spandrels 15 and 14 of the end wall panel assembly 110 are constructed in a similar manner as the concrete spandrels 10-13 of the wall panel assembly 100. Specifically, the embedded shear studs 28 are welded to steel members 25-26 at incremental spaces as required by the art and the building code, such as a single row of shear studs 28 (or two adjacent rows created by pair of shear studs 28) spaced every twelve or twenty four inches, centered along the bottom flange 22' of each steel member 25-26. The steel members 25-26 are preferably placed over the form for casting tilt-up assembly 110 prior to casting, with the shear studs 28 positioned to extend into the casting space for each of spandrels 14-15 through an appropriately-designed rebar mat 19.

FIG. 4, shows the placement of the steel members 25-26, rebar mat 19, and embedded shear studs 28 within the spandrel 15 variation of concrete spandrel 10. The rebar mat 19 extends to the perimeter of the form and is supported by spacers (not depicted) to raise the mesh off the bottom surface of the form. This allows a reasonable amount of concrete to cover the rebar mat 19. Said rebar mat 19 can be of any numerous types as are known in the art that may not have been specifically disclosed but would fall within the scope of the invention, including double or single mat.

A form is constructed and concrete is poured as is known in the art. The casting surface is typically treated with a bond-breaker material to prevent the newly poured concrete from adhering to the floor. The concrete is cured and treated as is known in the art. Once the concrete is adequately dry and cured, the tiltwall assembly 100 forms a multi-story assembly of multiple concrete spandrels 10 in which the anchors of the steel columns are embedded such that the columns unite the sub-casted concrete spandrels 10 into a composite tiltwall assembly 100. The forms are then removed from the sub-castings, and the composite tiltwall assembly 100 is tilted to the vertical by conventional means. More particularly, overhead cranes are preferably used for tilting-up the composite tiltwall assembly 100. The lifting hooks of such cranes are typically connected to the steel columns 20 of the composite tiltwall assembly 100, at through holes, rings or other conventional accommodations at locations 31*a*-31*d*. Hook-receiving embeds are also preferably cast into various ones of concrete spandrels 10 such as shown at reference numerals 30*a*-30*h* in FIG. 1, to provide alternative or secondary lifting points for tilting and otherwise maneuvering the composite tiltwall assembly 100. The lifting, placing, and bracing of the panels are alternatively accomplished by any suitable means as is conventional in the tilt-up panel industry.

Reference is now made to FIG. 6, which is a perspective view of the wall panel assembly 100 as completed. The concrete spandrels 10-13 are attached to steel members 20-21, preferably during the casting process, as discussed previously. Once the resulting tiltwall assembly 100 is tilted to the vertical position and positioned as appropriate on slab 250, it is then braced in place, and the steel members 20-21 are then permanently united to the foundation 250 (using conventional means) in order to thereafter serve as structural steel columns 20-21. As will be evident to those of knowledge in the construction industry, such permanent uniting is preferably accomplished by welding the lowermost ends 27-28 of columns 20-21, respectively to embed plates or the like embedded in foundation 250 at the desired locations for supporting tiltwall assemblies 100. As will also be understood, ends 27-28 preferably do not extend quite to the end of lower spandrel 10, which produces gap 99 as visible in FIG. 1. Gap 99 is preferably provided by design in order to allow for fittings as well as a lug notch 251 into which the lower edge of spandrel 10 will extend. Lowermost ends 27-28 are also preferably modified by the addition of a mounting plate to be positioned flush atop the corresponding embedded plate in foundation 250. Various alternative techniques for connecting member 21-22 to foundation 250 may be used without departing from the more basic teachings of this invention.

FIG. 6 also illustrates the attachment of various steel ledgers 41-43 and 51-56 to the tiltwall assemblies 100 and their various concrete spandrels 10. In the preferred embodiment, ledgers 41-43 are all of the same basic kind, which is referenced as the embed ledger type 40, and ledgers 51-56 are all of the same basic kind as each other, which is referenced as the welded ledger type 50. As will be understood by those of skill in the art, the ledgers 41-43 and 51-56 may be of any suitable form for connecting tiltwall assemblies 100 to structural joists 60 in a building construction 200, 210. As will also be understood, the ends of structural steel joists 60 are welded and otherwise connected to the various ledgers 41-46, 51-56 and 51'-56' in ways that are conventional in the tilt-up industry. It should be noted, nonetheless, that the joists 60 (such as joist 63 of FIG. 6) that are connected to the embed type of ledgers 40 should be slightly longer than those (such as joists 61 and 62) that are connected to the welded type of ledgers 50, to accommodate for the off-set spacing caused by the steel members 20-21, 25-26 between the two types of ledgers 40 and 50.

In one preferred embodiment, each of the two ledger types 40, 50 are formed by 5-by-5 angle steel, although square tube or other known ledger forms may be used in alternative embodiments. With cross-reference to FIG. 8, the embed steel ledger type 40 is preferably fitted with a row of stud-welded shear studs 48 (shown in hidden line) extending from the lower surface of each ledger 41-46 of the embed ledger type 40. Much as with the studs 28 of columns 20-21, prior to casting, the studs 48 may be tied to the rebar mat 19 of the corresponding concrete spandrel 10, and the ledger 40 is then cast as an embed in the corresponding concrete spandrel 10 at the same time as columns 20-21, and in much the same manner. Alternative embodiments achieve a comparable structure by fastening the ledger type 40 to the concrete spandrel 10 with cast in place HCA or post-installed anchors. In contrast, welded ledger type 50 is preferably welded or fastened to the upper flange 23 of steel members 20-21, in an orientation and manner that can be appreciated from the illustration of FIG. 8. Other angle bars, flanges, embeds and the like known in the art, of any suitable size, shape or number, may also be used or may be substituted for the illustrated ledgers 41-43 and 51-56 of FIG. 6 (as well as for ledgers 44-46 and 51'-56' of FIG. 7). Those skilled in the art will have an understanding of where the various types of embeds, inserts, and the like are also positioned in the concrete spandrel 10 variants.

Reference is now made to FIG. 7, which is a perspective view of the end wall panel assembly 110. The concrete spandrels 15 and 14 are attached to steel members 25-26 as discussed previously. Much as with tiltwall panel 100, once the resulting tiltwall assembly 110 is tilted to the vertical position and positioned as appropriate on slab 250, it is then braced in place, and the steel members 25-26 are then permanently united to the foundation 250 (using conventional means) in order to thereafter serve as structural steel columns 25-26. As will be evident to those of knowledge in the construction industry, such permanent uniting is preferably accomplished by welding the lowermost ends 27'-28' of columns 25-26, respectively, to embed plates or the like embedded in foundation 250 at the desired locations for supporting tiltwall assemblies 110. As will also be understood, ends 27'-28' preferably do not extend quite to the end of lower spandrel 14 in order to allow for fittings as well as a lug notch 251 into which the lower edge of spandrel 14 will extend. Lowermost ends 27'-28' are also preferably modified by the addition of a mounting plate to be positioned flush atop the corresponding embedded plate in foundation 250. Various alternative techniques for connecting member 25-26 to foundation 250 may be used without departing from the more basic teachings of this invention.

FIG. 7 also shows the arrangement of various steel ledgers 44-46 that are integrally connected to the concrete spandrels 14-15 or, in alternative embodiments, to mounting inserts that are cast into the various portions of concrete spandrels 14-15. Much as with tiltwall panel 100 of FIG. 6, end tiltwall panel 110 also has the welded ledger types 50 integrally joined to each steel member 25-26—namely ledgers 51', 53' and 55' welded to member 25, and ledgers 52', 54' and 56' welded to member 26. Steel bearing ledgers type 50 are welded or fastened to the flanges 23*a'* and 23*b'* of the steel members 25 and 26, respectively. Embedded steel bearing ledger 44-46 are preferably secured with embedded shear studs 28 much the same as with tiltwall panel 100, although alternative embodiments may be welded or bolted to embedded plates in the concrete spandrels 14-15, or may be fastened to the concrete spandrels 14-15 with cast-in-place HCA or post-installed anchors. Those skilled in the art will have an understanding of where the various types of embeds, inserts, and the like are also positioned in the spandrel 14-15 variations of concrete spandrel 10.

Finally, reference is made to FIGS. 5 and 9 which depict alternative building arrangements 200, 210 of tiltwall assemblies 100 constructed according to the teachings of the present invention. FIG. 5 depicts a concept building arrangement 200 showing the general placement of six wall panel assemblies 100 and four end wall panel assemblies 110, 111. Although not described directly in other figures, it should be evident that the end wall panel assemblies 111 are substantially similar to end assemblies 110, except that each end assembly 111 is constructed as a mirror image of the end assemblies 110. FIG. 5 depicts an advantage of the present embodiment, in that the builder has the option to construct a strip window 170 with minimal obstruction by building structural components. The present invention allows a builder freedom to configure the internal walls and office space in many more combinations without regard to large concrete building elements potentially blocking windows or otherwise constraining the optimal use of internal space. It should be noted that the present invention allows for the use of various cosmetic facades and other features to be attached to the tiltwall panel assemblies 100 as is known in the art.

In comparison, FIG. 9 illustrates an alternative building arrangement 210 of tiltwall assemblies 100 in a slightly more stylistic overall arrangement 210. As with building arrangement 200, the combination of the various tiltwall panel assemblies 100' into an arrangement 210 as shown in FIG. 9 provides horizontal, ribbon-like open spans 170*a'*-170*c'* across multiple tiltwall panel assemblies 100'. Once the tiltwall panel assemblies 100' are arranged and secured in position as shown in FIG. 9, ribbon-like horizontal bands of window glass are then installed in those open spans 170*a'*-170*c'* to provide an attractive exterior look, minimal interior window obstructions, and maximum natural lighting, while still taking advantage of tilt-up cost advantages. Indeed, the cost advantages are enhanced by the various factors discussed previously in this application.

As one of skill in tilt-up construction can appreciate, many other alternative arrangements can be constructed to achieve different stylistic benefits according to the teachings of the present invention. For instance, tiltwall assemblies 100 according to the teachings of this invention can be combined with conventional tiltwall panels or with open vertical spans that are spanned by structural steel beams such as adjacent the forwardmost corner of the building 210 of FIG. 9. As another alternative, the lower spandrel 10 may be omitted in a tiltwall assembly 100 in order to achieve slightly different aesthetic, structural and functional results. Many other variations can also be imagined as a result of these teachings herein, all of which are intended to be encompassed within the invention as claimed except to the extent anticipated by or made legally obvious by the prior art, or to the extent clearly and unequivocally disclaimed.

Even though the embodiments illustrated and discussed herein represent the most preferred at present, those of ordinary skill in the art will recognize many possible alternatives that we have not expressly suggested here. While the foregoing written descriptions enable one of ordinary skill to make and use what is presently considered to be the best modes of the invention, those of ordinary skill will understand and appreciate the existence of variations, combinations, and equivalents of the specific embodiment, method, and examples herein. The drawings and detailed descriptions herein are illustrative, not exhaustive. They do not limit the invention to the particular forms and examples disclosed. To the contrary, the invention includes any further modifications, changes, rearrangements, substitutions, alternatives, design choices, and embodiments apparent to those of ordinary skill in the art, without departing from the spirit and scope of this invention, as defined by any claims included herewith or later added or amended in an application claiming priority to this present filing. The invention covers all embodiments within the scope and spirit of such claims, irrespective of whether such embodiments have been remotely referenced here or whether all features of such embodiments are known at the time of this filing. Thus, the claims should be interpreted to embrace all further modifications, changes, rearrangements, substitutions, alternatives, design choices, and embodiments that may be evident to those of skill in the art. In any case, all substantially equivalent systems, articles, and methods should be considered within the scope of the present invention.

What is claimed is:

1. An improved tiltwall construction method for constructing an attractive yet affordable building, comprising:

A. casting a plurality of at least two non-contiguous reinforced concrete castings on one or more casting surfaces, said at least two non-contiguous reinforced concrete castings comprising a first reinforced concrete casting and a second reinforced concrete casting that are non-contiguous such that they are relatively positioned with a span of separation between them;

B. structurally securing at least two substantially parallel structural steel columns to each of said at least two non-contiguous reinforced concrete castings, whereby said at least two structural steel columns and said at least two non-contiguous reinforced concrete castings are integrally united to form a composite tilt-up panel assembly while one or more of said at least two non-contiguous reinforced concrete castings are positioned on one of said one or more casting surfaces, said structurally securing step comprising:

i. positioning each of said at least two structural steel columns to span across said span of separation between said first reinforced concrete casting and said second reinforced concrete casting, and ii. securing each of said at least two substantially parallel structural steel columns to each of said first and second reinforced concrete castings in a manner that permanently positions said first reinforced concrete casting to be spaced apart from said second reinforced concrete casting, thereby permanently maintaining said span of separation and the noncontiguous relationship between said first and second reinforced concrete castings; and C. tilting said composite tilt-up panel assembly from a substantially horizontal position to an upright position, wherein said tilting step occurs after said structurally securing step and comprises tilting said composite tilt-up panel assembly to an upright position wherein said second concrete casting is positioned above said first concrete casting and said span of separation is a vertical span between said first and second reinforced concrete castings.

2. An improved tiltwall construction method as in claim 1, further comprising:

A. forming a slab foundation for said building; and

B. said casting step comprises using a surface of said slab foundation as a casting surface for said reinforced concrete castings.

3. An improved tiltwall construction method as in claim 1, further comprising:

A. forming a slab foundation for said building, said slab foundation including a steel embed plate; and B. after said tilting step, permanently securing a plate formed integrally at an end of said at least two steel columns flush against said steel embed plate of said slab foundation, thereby permanently connecting said composite tilt-up panel assembly to said slab foundation in said upright position.

4. An improved tiltwall construction method as in claim 1, wherein said plurality of at least two non-contiguous reinforced concrete castings each has a first edge and a second edge that are generally parallel, and each of said structural steel columns are united to said castings in an orientation that is generally perpendicular to said first and second edges.

5. An improved tiltwall construction method as in claim 4, wherein the first and second edges of one of said at least two reinforced concrete castings are generally parallel to the first and second edges of the others of said at least two non-contiguous reinforced concrete castings, such that said castings have the appearance of parallel spandrels when said composite tilt-up panel assembly is positioned in an upright orientation.

6. An improved tiltwall construction method as in claim 4, wherein each of said substantially parallel structural steel columns has a lengthwise flange that presents a generally flat surface abutting an upward surface of said at least two castings during said casting step.

7. An improved tiltwall construction method as in claim 6, wherein said flange includes at least two arrangements of anchors extending from said generally flat surface for integrally embedding in said at least two castings, respectively.

8. An improved tiltwall construction method as in claim 7, further comprising securing an anchor of said anchor arrangements to steel reinforcement in said at least two non-contiguous castings.

9. An improved tiltwall construction method as in claim 1, wherein said at least two castings comprise at least three non-contiguous reinforced concrete castings on one or more casting surfaces; said improved tiltwall construction method further comprising installing a ledger integrally united with one of said at least three castings to permanently protrude from an upward face of said one of said at least three castings prior to the tilting step.

10. An improved tiltwall construction method as in claim 1, wherein said improved tiltwall construction method is for constructing an attractive yet affordable multistory building, further comprising:

A. prior to said casting step, forming a slab foundation for said multistory building, said slab foundation including first and second steel embed plates positioned to be used as bearing surfaces for supporting structural columns of said multistory building;

B. prior to said casting step, creating forms for casting said at least two non-contiguous reinforced concrete castings in at least two corresponding casting spaces on a surface of said slab foundation, each of said forms defining an elongate, generally rectangular shape for said corresponding casting spaces, such that said at least two non-contiguous reinforced concrete castings are cast to have a generally rectangular shape;

C. prior to said casting step, positioning rebar mats in said at least two corresponding casting spaces of said forms;

D. prior to said structurally securing step, providing said at least two substantially parallel structural steel columns formed of structural steel, said at least two substantially parallel structural steel columns comprising a multistory column, said multistory column having a column surface for facing said reinforced concrete castings, and said multistory column having an integral base plate at an end thereof;

E. providing a plurality of anchors for embedding within said at least two non-contiguous reinforced concrete castings, said plurality of anchors being integrally connected to the column surface of said multistory column to extend from the column surface;

F. said structurally securing step comprising positioning each of said structural steel columns in an orientation such that the lengths of said columns are generally perpendicular to the elongate dimensions of the generally rectangular shapes of said at least two non-contiguous reinforced concrete castings and such that the column surface provided with anchors is facing said at least two corresponding casting spaces of said forms;

G. structurally securing said at least two substantially parallel structural steel columns to each of said at least two non-contiguous reinforced concrete castings, said at least two substantially parallel structural steel columns and said at least two non-contiguous reinforced concrete castings being integrally united to form a composite tilt-up panel assembly;

H. said structurally securing step being accomplished at least in part by virtue of said casting step, said casting step comprising concurrently casting said at least two non-contiguous reinforced concrete castings in said at least two corresponding spaces in a manner such that said anchors are embedded in concrete of said at least two non-contiguous reinforced concrete castings, thereby integrally uniting said multistory column to each of said at least two non-contiguous reinforced concrete castings; and I. after said tilting step, permanently securing the base plate of said multistory column flush against at least one of said steel embed plates of said slab foundation, thereby permanently connecting said composite tilt-up panel to said slab foundation in said upright position.

11. The improved tiltwall construction method of claim 10, wherein said first plurality of anchors comprise stud-welded anchors that are stud-welded to the column surface of said multistory column, and wherein said at least two non-contiguous reinforced concrete castings comprise at least three non-contiguous reinforced concrete castings.

12. An improved tiltwall construction method for constructing an attractive yet affordable multistory building, comprising:

A. forming a slab foundation for said multistory building, said slab foundation including first and second steel embed plates positioned to be used as bearing surfaces for supporting structural columns of said multistory building;

B. creating forms for casting at least two non-contiguous reinforced concrete castings in at least two corresponding casting spaces on a surface of said slab foundation;

C. positioning rebar mats in said at least two corresponding casting spaces of said forms;

D. each of said forms defining an elongate, generally rectangular shape for said corresponding casting spaces, such that reinforced concrete castings cast therein have a generally rectangular shape;

E. after each of said slab foundation forming step, said forms creating step, and said rebar mats positioning step, casting a plurality of at least two non-contiguous reinforced concrete castings on one or more casting surfaces, said at least two non-contiguous reinforced concrete castings comprising a first reinforced concrete casting and a second reinforced concrete casting that are non-contiguous such that they are relatively positioned with a span of separation between them, said at least two non-contiguous reinforced concrete castings comprise at least three non-contiguous reinforced concrete castings;

F. providing at least two substantially parallel structural steel columns formed of structural steel, said at least two substantially parallel structural steel columns comprising a multistory column, said multistory column having a column surface for facing said reinforced concrete castings, and said multistory column having an integral base plate at an end thereof;

G. providing a first plurality of anchors for embedding within said at least two non-contiguous reinforced concrete castings, said first plurality of anchors being integrally connected to the column surface of said multistory column to extend from the column surface, said first plurality of anchors comprising stud-welded anchors that are stud-welded to the column surface of said multistory column;

H. after said columns providing step, structurally securing said at least two substantially parallel structural steel columns to each of said at least two non-contiguous reinforced concrete castings, whereby said at least two structural steel columns and said at least two non-contiguous reinforced concrete castings are integrally united to form a composite tilt-up panel assembly while one or more of said at least two non-contiguous reinforced concrete castings are positioned on one of said one or more casting surfaces, said structurally securing step comprising positioning each of said structural steel columns in an orientation such that the lengths of said columns are generally perpendicular to the elongate dimensions of the generally rectangular shapes of said at least two non-contiguous reinforced concrete castings and such that the column surface provided with anchors is facing said at least two corresponding casting spaces of said forms;

I. said structurally securing step being accomplished at least in part by virtue of said casting step, said casting step comprising concurrently casting said at least two non-contiguous reinforced concrete castings in said at least two corresponding spaces in a manner such that said anchors are embedded in concrete of said at least two non-contiguous reinforced concrete castings, thereby integrally uniting said multistory column to each of said at least two non-contiguous reinforced concrete castings;

J. said structurally securing step comprises (i) positioning each of said at least two structural steel columns to span across said span of separation between said first reinforced concrete casting and said second reinforced concrete casting, and (ii) securing each of said at least two substantially parallel structural steel columns to each of said first and second reinforced concrete castings in a manner that permanently positions said first reinforced concrete casting to be spaced apart from said second reinforced concrete casting, thereby permanently maintaining said span of separation and the noncontiguous relationship between said first and second reinforced concrete castings;

K. after said structurally securing step, tilting said composite tilt-up panel assembly from a substantially horizontal position to an upright position, said tilting step comprising tilting said composite tilt-up panel assembly to an upright position wherein said second concrete casting is positioned above said first concrete casting and said span of separation is a vertical span between said first and second reinforced concrete castings;

L. after said tilting step, permanently securing the base plate of said multistory column flush against at least one of said steel embed plates of said slab foundation, thereby permanently connecting said composite tilt-up panel to said slab foundation in said upright position; and M. installing window glass in said span of separation to provide a ribbon-like horizontal band of window glass across said composite tiltwall panel. assembly after said tilting step has occurred.

13. An improved tiltwall construction method as in claim 12 wherein:

A. said forms creating step comprises creating forms for casting said at least two non-contiguous reinforced concrete castings in a manner such that each of said at least two non-contiguous reinforced concrete castings cast therein has a first edge and a second edge that are generally parallel; and B. said structurally securing step unites each of said at least two structural steel columns to said castings in an orientation that is generally perpendicular to said first and second edges.

14. An improved tiltwall construction method as in claim 13, wherein said structurally securing step unites said columns and said castings in an orientation such that the first and second edges of one of said at least two reinforced concrete castings are generally parallel to the first and second edges of the others of said at least two non-contiguous reinforced concrete castings, such that said castings have the appearance of parallel spandrels when said composite tilt-up panel assembly is positioned in an upright position.

15. An improved tiltwall construction method as in claim 13, wherein said column providing step comprises providing each of said substantially parallel structural steel columns with a lengthwise flange that provides said column surface a generally flat surface for abutting an upward surface of said at least two castings during said casting step.

16. An improved tiltwall construction method as in claim 15, wherein said flange includes at least two arrangements of anchors extending from said generally flat surface for integrally embedding in said at least two castings, respectively.

17. An improved tiltwall construction method as in claim 16, further comprising securing an anchor of said anchor arrangements to steel reinforcement in said at least two non-contiguous castings.

18. An improved tiltwall construction method as in claim 12, wherein said at least two castings comprise at least three non-contiguous reinforced concrete castings on one or more casting surfaces; said improved tiltwall construction method further comprising installing a ledger integrally united with one of said at least three castings to permanently protrude from an upward face of said one of said at least three castings prior to the tilting step.

19. An improved tiltwall construction method as in claim 12, wherein said slab foundation formed by said forming step comprises reinforced concrete.

20. An improved tiltwall construction method for constructing an attractive yet affordable multistory building, comprising:

A. forming a slab foundation for said multistory building, wherein said slab foundation formed by said forming step comprises reinforced concrete, said slab foundation including first and second steel embed plates positioned to be used as bearing surfaces for supporting structural columns of said multistory building;

B. creating forms for casting at least two non-contiguous reinforced concrete castings in at least two corresponding casting spaces on a surface of said slab foundation;

C. positioning rebar mats in said at least two corresponding casting spaces of said forms;

D. each of said forms defining an elongate, generally rectangular shape for said corresponding casting spaces, such that reinforced concrete castings cast therein have a generally rectangular shape wherein said forms creating step comprises creating forms for casting said at least two non-contiguous reinforced concrete castings in a manner such that each has a first edge and a second edge that are generally parallel;

E. after each of said slab foundation forming step, said forms creating step, and said rebar mats positioning step, casting a plurality of at least two non-contiguous reinforced concrete castings on one or more casting surfaces, said at least two non-contiguous reinforced concrete castings comprising a first reinforced concrete casting and a second reinforced concrete casting that are non-contiguous such that they are relatively positioned with a span of separation between them, said at least two non-contiguous reinforced concrete castings comprise at least three non-contiguous reinforced concrete castings on one or more casting surfaces, the casting step further comprising installing a ledger integrally united with one of said at least three castings to permanently protrude from an upward face of said one of said at least three castings prior to the tilting step;

F. providing at least two substantially parallel structural steel columns formed of structural steel, said at least two substantially parallel structural steel columns comprising a multistory column, said multistory column having a column surface for facing said reinforced concrete castings, and said multistory column having an integral base plate at an end thereof, and wherein:

i. said column providing step comprises providing each of said substantially parallel structural steel columns with a lengthwise flange that provides said column surface a generally flat surface for abutting an upward surface of said at least two castings during said casting step; and ii. said column providing step further comprises said flange including at least two arrangements of anchors extending from said generally flat surface for integrally embedding in said at least two castings, respectively;

G. providing a first plurality of anchors for embedding within said at least two non-contiguous reinforced concrete castings, said first plurality of anchors being integrally connected to the column surface of said multistory column to extend from the column surface, said first plurality of anchors comprising stud-welded anchors that are stud-welded to the column surface of said multistory column;

H. after said columns providing step, structurally securing said at least two substantially parallel structural steel columns to each of said at least two non-contiguous reinforced concrete castings, whereby said at least two structural steel columns and said at least two non-contiguous reinforced concrete castings are integrally united to form a composite tilt-up panel assembly while one or more of said at least two non-contiguous reinforced concrete castings are positioned on one of said one or more casting surfaces, said structurally securing step comprising positioning each of said structural steel columns in an orientation such that the lengths of said columns are generally perpendicular to the elongate dimensions of the generally rectangular shapes of said at least two non-contiguous reinforced concrete castings and such that the column surface provided with anchors is facing said at least two corresponding casting spaces of said forms wherein:

i. said structurally securing step unites each of said at least two structural steel columns to said castings in an orientation that is generally perpendicular to said first and second edges; and ii. said structurally securing step unites said columns and said castings in an orientation such that the first and second edges of one of said at least two reinforced concrete castings are generally parallel to the first and second edges of the others of said at least two non-contiguous reinforced concrete castings, such that said castings have the appearance of parallel spandrels when said composite tilt-up panel assembly is positioned in an upright position;

I. said structurally securing step being accomplished at least in part by virtue of said casting step, said casting step comprising concurrently casting said at least two non-contiguous reinforced concrete castings in said at least two corresponding spaces in a manner such that said anchors are embedded in concrete of said at least two non-contiguous reinforced concrete castings, thereby integrally uniting said multistory column to each of said at least two non-contiguous reinforced concrete castings, said structurally securing step further comprising securing an anchor of said anchor arrangements to steel reinforcement in said at least two non-contiguous castings;

J. said structurally securing step comprises (i) positioning each of said at least two structural steel columns to span across said span of separation between said first reinforced concrete casting and said second reinforced concrete casting, and (ii) securing each of said at least two substantially parallel structural steel columns to each of said first and second reinforced concrete castings in a manner that permanently positions said first reinforced concrete casting to be spaced apart from said second reinforced concrete casting, thereby permanently maintaining said span of separation and the noncontiguous relationship between said first and second reinforced concrete castings;

K. after said structurally securing step, tilting said composite tilt-up panel assembly from a substantially horizontal position to an upright position, said tilting step comprising tilting said composite tilt-up panel assembly to an upright position wherein said second concrete casting is positioned above said first concrete casting and said span of separation is a vertical span between said first and second reinforced concrete castings;

L. after said tilting step, permanently securing the base plate of said multistory column flush against at least one of said steel embed plates of said slab foundation, thereby permanently connecting said composite tilt-up panel to said slab foundation in said upright position, wherein said permanently securing step comprises providing an exterior wall standing on said slab foundation, said exterior wall comprising at least one composite tiltwall panel, said exterior wall defining a window opening that spans across the entire width of said composite tiltwall panel, said composite tiltwall panel comprising two spandrels and said at least two structural steel columns, said two spandrels being non-contiguous with each other and having orientations that are substantially parallel relative to each other, such that one spandrel is spaced from and above the other spandrel, defining a vertical span between the two spandrels, said window opening portion spanning the entire width of said composite tiltwall panel defined in part by said vertical span between two spandrels;

M. said permanently securing step comprises providing a plurality of tiltwall panels such that the exterior wall comprises at least said composite tiltwall panel and two additional tiltwall panels, one tiltwall panel installed on each opposite side of said composite tiltwall panel, each of said two additional panels defining side openings that are aligned with said window opening portion defined by said composite tiltwall panel, said window opening including said window opening portion that spans the entire width of said composite tiltwall panel, and also including the side openings of said two additional tiltwall panes, such that said window opening extends horizontally across more than one of said tiltwall panels;

N. said permanently securing step wherein said exterior wall further comprises positioning a second composite tiltwall panel beside the first composite tiltwall panel, said second composite tiltwall panel being structurally secured to maintain a permanent position relative to said first composite tiltwall panel, integrally uniting each of said first and second composite tiltwall panels having two (or more) spandrels with at least two structural steel columns, positioning the two spandrels of said second composite tiltwall panel at substantially the same height and having substantially the same height dimensions as two spandrels of said first composite tiltwall panel such that the two spandrels of said second composite tiltwall panel appear aligned with the two spandrels of said first composite tiltwall panel, the window opening portion that spans across the entire width of said first composite tiltwall panel also spans the entire width of said second tiltwall panel, thereby giving the window opening portion a vertical dimension that is substantially constant across the width of said window opening portion; and O. installing window glass in said span of separation to provide a ribbon-like horizontal band of window glass across said composite tiltwall panel. assembly after said tilting step has occurred, wherein said window comprises one or more coplanar panes of transparent window material spanning substantially all of said window opening portion, thereby providing a strip of window having a horizontally-extended ribbon glass appearance.

* * * * *